US008001765B2

(12) United States Patent
Kawakita et al.

(10) Patent No.: US 8,001,765 B2
(45) Date of Patent: Aug. 23, 2011

(54) SYSTEM OPERABLE TO CONTROL EXHAUST GAS EMISSION OF ENGINE

(75) Inventors: Koji Kawakita, Ohbu (JP); Katsunori Ueda, Okazaki (JP); Toshiyuki Miyata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 742 days.

(21) Appl. No.: 12/053,349

(22) Filed: Mar. 21, 2008

(65) Prior Publication Data

US 2008/0245056 A1 Oct. 9, 2008

(30) Foreign Application Priority Data

Apr. 9, 2007 (JP) ..... P2007-102092

(51) Int. Cl.
*F01N 3/00* (2006.01)
*F01N 3/10* (2006.01)
*F02D 41/12* (2006.01)

(52) U.S. Cl. ..... 60/276; 60/285; 60/299; 123/326

(58) Field of Classification Search ..... 60/276, 60/285, 299; 123/326
See application file for complete search history.

(56) References Cited

U.S. PATENT DOCUMENTS 5,438,826 A * 8/1995 Blischke et al. ..... 60/276
6,600,998 B1 * 7/2003 Majima et al. ..... 702/24
6,751,950 B2 * 6/2004 Ikemoto et al. ..... 60/285
6,760,658 B2 * 7/2004 Yasui et al. ..... 701/106
2005/0262831 A1 * 12/2005 Shouda et al. ..... 60/285
2008/0147297 A1 * 6/2008 Nakagawa et al. ..... 701/103

FOREIGN PATENT DOCUMENTS

JP 2006-118433 A 5/2006
JP 2006-194118 7/2006
JP 2006-250043 9/2006

* cited by examiner

*Primary Examiner* — Thomas E Denion
*Assistant Examiner* — Audrey Klasterka
(74) *Attorney, Agent, or Firm* — Birch, Stewart, Kolasch & Birch, LLP

(57) ABSTRACT

A system operable to control an exhaust gas emission of an engine, includes a catalytic converter; a fuel cutter, a change executor, a correlation value provider, an adjuster, and a controller. The change executor is operable to execute changing of an air-fuel ratio of the engine to a rich air-fuel ratio after the fuel supply is once stopped by the fuel cutter and then resumed. The correlation value provider is operable to provide a correlation value correlated to a change amount of the air-fuel ratio caused by the change executor based on a driving condition of the engine. The adjuster is operable to adjust the correlation value based on a parameter indicative of a capability of the catalytic converter. The controller is operable to cause the change executor to execute the changing based on the adjusted correlation value.

10 Claims, 5 Drawing Sheets

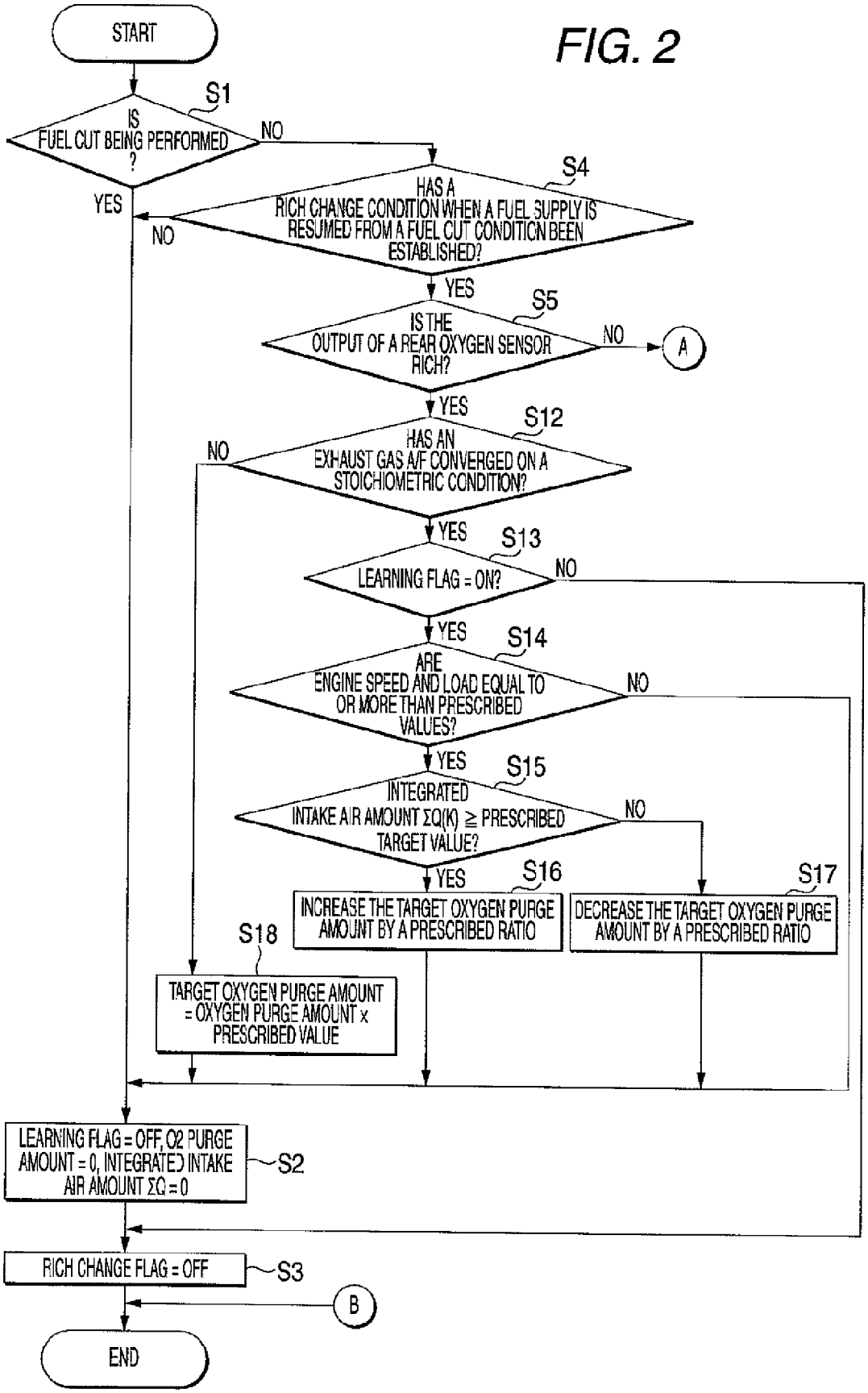
FIG. 2
START
S1
IS FUEL CUT BEING PERFORMED ?
NO
YES
S4
HAS A RICH CHANGE CONDITION WHEN A FUEL SUPPLY IS RESUMED FROM A FUEL CUT CONDITION BEEN ESTABLISHED?
NO
YES
S5
IS THE OUTPUT OF A REAR OXYGEN SENSOR RICH?
NO
A
YES
S12
HAS AN EXHAUST GAS A/F CONVERGED ON A STOICHIOMETRIC CONDITION?
NO
YES
S13
LEARNING FLAG = ON?
NO
YES
S14
ARE ENGINE SPEED AND LOAD EQUAL TO OR MORE THAN PRESCRIBED VALUES?
NO
YES
S15
INTEGRATED INTAKE AIR AMOUNT ΣQ(K) ≧ PRESCRIBED TARGET VALUE?
NO
YES
S16
INCREASE THE TARGET OXYGEN PURGE AMOUNT BY A PRESCRIBED RATIO
S17
DECREASE THE TARGET OXYGEN PURGE AMOUNT BY A PRESCRIBED RATIO
S18
TARGET OXYGEN PURGE AMOUNT = OXYGEN PURGE AMOUNT x PRESCRIBED VALUE
LEARNING FLAG = OFF, O2 PURGE AMOUNT = 0, INTEGRATED INTAKE AIR AMOUNT ΣQ = 0
S2
RICH CHANGE FLAG = OFF
S3
B
END

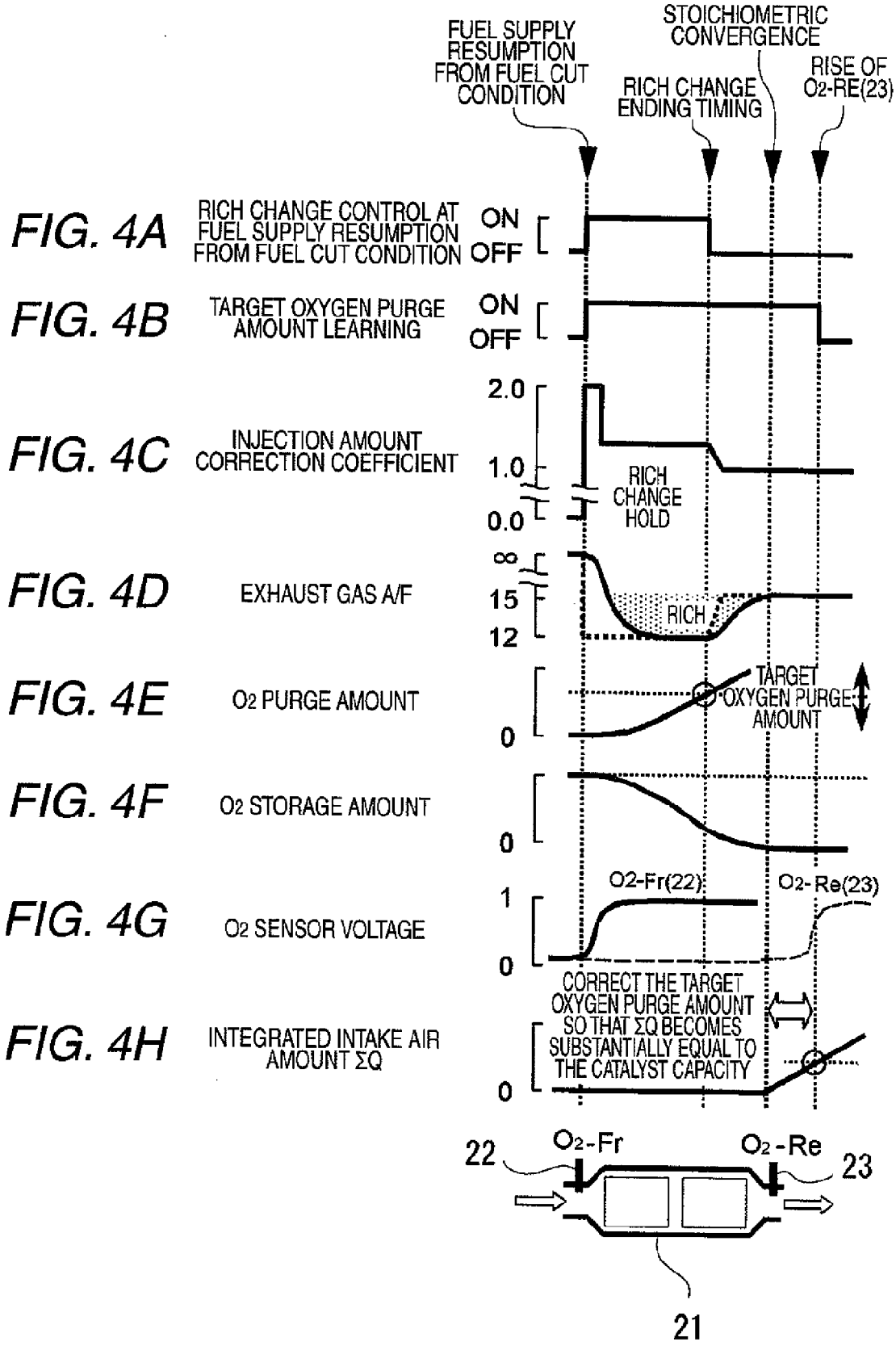
FUEL SUPPLY RESUMPTION FROM FUEL CUT CONDITION
STOICHIOMETRIC CONVERGENCE
RICH CHANGE ENDING TIMING
RISE OF O2-RE(23)
FIG. 4A
RICH CHANGE CONTROL AT FUEL SUPPLY RESUMPTION FROM FUEL CUT CONDITION
ON
OFF
FIG. 4B
TARGET OXYGEN PURGE AMOUNT LEARNING
ON
OFF
FIG. 4C
INJECTION AMOUNT CORRECTION COEFFICIENT
2.0
1.0
0.0
RICH CHANGE HOLD
FIG. 4D
EXHAUST GAS A/F
∞
15
12
RICH
FIG. 4E
O2 PURGE AMOUNT
0
TARGET OXYGEN PURGE AMOUNT
FIG. 4F
O2 STORAGE AMOUNT
0
FIG. 4G
O2 SENSOR VOLTAGE
1
0
O2-Fr(22)
O2-Re(23)
FIG. 4H
INTEGRATED INTAKE AIR AMOUNT ΣQ
0
CORRECT THE TARGET OXYGEN PURGE AMOUNT SO THAT ΣQ BECOMES SUBSTANTIALLY EQUAL TO THE CATALYST CAPACITY
22
O2-Fr
O2-Re
23
21

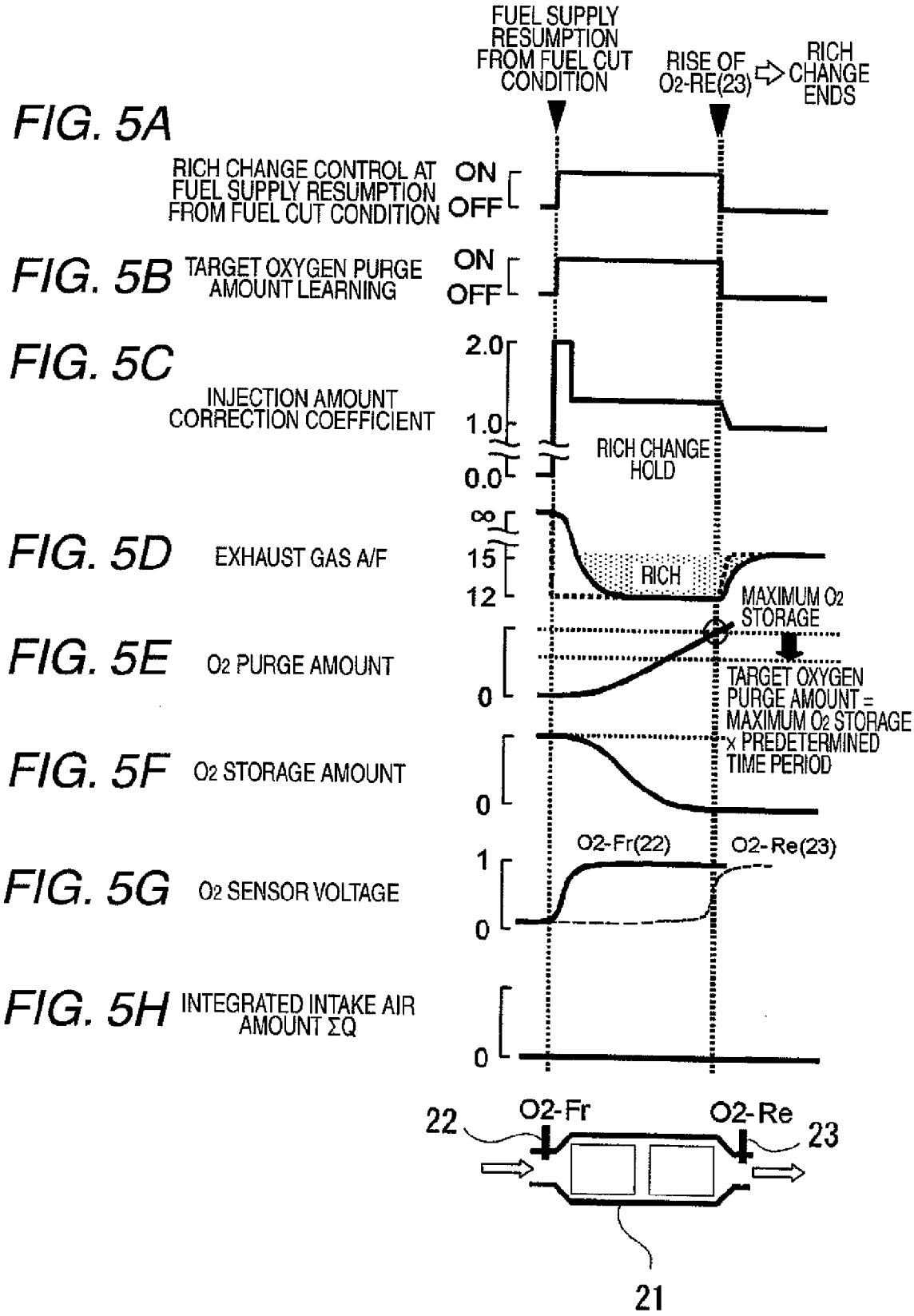
FUEL SUPPLY RESUMPTION FROM FUEL CUT CONDITION
RISE OF O2-RE(23)
RICH CHANGE ENDS
FIG. 5A
RICH CHANGE CONTROL AT FUEL SUPPLY RESUMPTION FROM FUEL CUT CONDITION
ON
OFF
FIG. 5B
TARGET OXYGEN PURGE AMOUNT LEARNING
ON
OFF
FIG. 5C
INJECTION AMOUNT CORRECTION COEFFICIENT
2.0
1.0
0.0
RICH CHANGE HOLD
FIG. 5D
EXHAUST GAS A/F
∞
15
12
RICH
MAXIMUM O2 STORAGE
FIG. 5E
O2 PURGE AMOUNT
0
TARGET OXYGEN PURGE AMOUNT = MAXIMUM O2 STORAGE × PREDETERMINED TIME PERIOD
FIG. 5F
O2 STORAGE AMOUNT
0
FIG. 5G
O2 SENSOR VOLTAGE
O2-Fr(22)
O2-Re(23)
1
0
FIG. 5H
INTEGRATED INTAKE AIR AMOUNT ΣQ
0
22
O2-Fr
O2-Re
23
21

SYSTEM OPERABLE TO CONTROL EXHAUST GAS EMISSION OF ENGINE

BACKGROUND

1. Field of the Invention

The present invention relates to an exhaust gas emission control system for an internal combustion engine, which is designed to increase further the exhaust gas emission controlling capability of a catalytic converter irrespective of running conditions of an engine or deterioration of the catalytic converter.

2. Description of the Related Art

A catalytic converter such as a three-way catalytic converter is provided in an exhaust passage of an internal combustion engine mounted on a vehicle for the purpose of removing unwanted exhaust gases such as hydrocarbons (HC), carbon monoxides (CO), oxides of nitrogen (NOx) and the like which are expelled from the internal combustion engine. Normally, in the catalytic converter of this type, noble metals are carried on a substrate, and oxidation reaction and reduction reaction of those substances of HC, CO and NOx are promoted by the noble metals.

The three-way catalytic converter has a function to adsorb oxygen to promote the reduction of NOx in a lean atmosphere (oxidation atmosphere), and then to desorb oxygen to promote oxidation reactions of HC and CO in a rich atmosphere (oxidation atmosphere).

Incidentally, in recent years, from the viewpoint of reduced fuel consumption and protection of a catalytic converter, a so-called fuel cut is implemented in which a fuel supply is stopped when the vehicle is decelerated. However, when such a fuel cut is implemented, a large amount of oxygen comes to be contained in exhaust gases, and since the catalytic converter is saturated with adsorbed oxygen, when the fuel supply is resumed (fueling resumption), the removal of NOx gets deteriorated.

In order to suppress the increase in volume of NOx produced in association with such a fuel cut, fuel is controlled so as to be increased in volume to change the air-fuel ratio to a slightly richer air-fuel ratio than the stoichiometric air-fuel ratio (a rich change control). By this rich change control, unburned HC and CO, which are reducing agents, are caused to exist much in exhaust gases, so that unburned HC and CO are allowed to react with oxygen adsorbed in the catalytic converter for the adsorbed oxygen to be purged therefrom (oxygen purging). As this occurs, by setting appropriately a timing at which the rich change control ends, the fuel supply amount is normalized and the discharge amount of HC, CO and NOx can be suppressed to a maximum level.

As a technique of setting appropriately the rich change control ending timing, there has been known a technique in which the rich change control is ended when a sensor value corresponding to a rich air-fuel ratio is outputted using an output of an air-fuel ratio sensor at an exit of a catalytic converter as a trigger. However, when the output of the air-fuel ratio sensor at the exit of the catalytic converter is used as the trigger, the rich change control is ended after oxygen adsorbed in the catalytic converter is completely desorbed therefrom (oxygen is completely purged) and exhaust gases, of which the air-fuel ratio is changed to the rich air-fuel ratio, start to be discharged. Due to this, fuel is supplied excessively, whereby unburned HC, CO are discharged, resulting in deterioration of the exhaust gas emission controlling capability of the catalytic converter.

As another technique of appropriately setting the rich change control ending timing, there has been proposed a technique in which a rich change control is set in advance to occur over a prescribed time period depending upon running conditions of the internal combustion engine, so that the rich change control is implemented over the prescribed time period so set, as disclosed in Japanese Patent Publication No. 2006-118433A. By implementing the rich change control over the prescribed time period which has been set in advance, the normalization of fuel supply amount according to the running conditions of the internal combustion engine can be realized when the fuel supply is resumed, thereby making it possible to increase the NOx removing capability.

In recent years, there has been an increasing demand for a further improvement in exhaust gas emission controlling capability of catalytic converters. For example, there exists a fear that the rich change control ending timing cannot stay appropriate due to difference in oxygen adsorbing capability between individual catalysts, changing oxygen adsorbing capability due to aging and changing running condition of the internal combustion engine, and hence, an exhaust gas emission control system has been desired which can maintain a high exhaust gas emission controlling capability not only in an initial stage but also in those circumstances of aging (deterioration) of the catalytic converter and changing running conditions of the internal combustion engine by properly coping with changes caused in those circumstances.

SUMMARY OF THE INVENTION

It is therefore one advantageous aspect of the invention to provide an exhaust gas emission control system for an internal combustion engine which can increase further the exhaust gas emission controlling capability of the catalytic converter irrespective of changing running conditions of the internal combustion engine or aging of the catalytic converter by setting properly a correlation value of a control to change the air-fuel ratio to a rich air-fuel ratio after a fuel cut has been implemented (a rich change control) so as to implement accurately the desorption of oxygen.

According to one aspect of the invention, there is provided a system operable to control an exhaust gas emission of an engine, the system including: a catalytic converter, provided on an exhaust passage of the engine; a fuel cutter, operable to stop a fuel supply to the engine; a change executor, operable to execute changing of an air-fuel ratio of the engine to a rich air-fuel ratio after the fuel supply is once stopped by the fuel cutter and then resumed; a correlation value provider, operable to provide a correlation value correlated to a change amount of the air-fuel ratio caused by the change executor based on a driving condition of the engine; an adjuster, operable to adjust the correlation value based on a parameter indicative of a capability of the catalytic converter; and a controller, operable to cause the change executor to execute the changing based on the adjusted correlation value.

A catalyst contained in a catalytic converter has a characteristic in which it adsorbs oxygen in the oxidation atmosphere where the oxygen concentration is high and desorbs the oxygen so adsorbed in a reduction atmosphere where the oxygen concentration is low. Since the amount of oxygen adsorbed in the catalyst is increased when a fuel cut is implemented, the air-fuel ratio is set to be changed to the rich air-fuel ratio over a prescribed time period after the fuel supply is resumed so as to allow much reducing constituents to flow into the catalyst to thereby release the oxygen adsorbed therein as quickly as possible.

According to the above aspect of the invention, when changing the air-fuel ratio of the internal combustion engine to the air-fuel ratio richer than the stoichiometric ratio after the prescribed stop of fuel supply is implemented, the correlation value which correlates with the extent to which the air-fuel ratio is changed to the air-fuel ratio richer than the stoichiometric ratio is set, the correlation value is modified based on the parameter reflecting the capability of the catalytic converter, and the next rich changing is implemented according to the result of the modification. By this configuration, since the accurate rich change control can be implemented irrespective of the capability of the catalytic converter or the running conditions of the internal combustion engine, the exhaust gas emission amount can be suppressed, thereby making it possible to increase the exhaust gas emission controlling performance.

The system may include an upstream detector, provided in an upstream side of the catalytic converter in the exhaust passage, and operable to detect an exhaust gas air-fuel ratio; and a downstream detector, provided in a downstream side of the catalytic converter in the exhaust passage, and operable to detect the exhaust gas air-fuel ratio. The adjuster may be operable to adjust the correlation value based on a time period from a timing at which the upstream detector detects that the exhaust gas air-fuel ratio is converged on the stoichiometric ratio to a timing at which the downstream detector detects that the exhaust gas air-fuel ratio is the rich air-fuel ratio.

According to the above, since the correlation value is modified based on the time period from the point in time at which the upstream detector detects that the exhaust gas air-fuel ratio has converged on the stoichiometric ratio to the point in time at which the downstream detector detects that the exhaust gas air-fuel ratio is rich, a correlation vale for the rich change control can be set using a desorption condition of exhaust gas constituents based on the index of the actual exhaust gas air-fuel ratio.

The system may include an upstream detector, provided in an upstream side of the catalytic converter in the exhaust passage, and operable to detect an exhaust gas air-fuel ratio; and a downstream detector, provided in a downstream side of the catalytic converter in the exhaust passage, and operable to detect the exhaust gas air-fuel ratio; and an air detector, operable to detect an air amount introduced into the engine. The adjuster may be operable to adjust the correlation value based on an integrated value of the air amount for a time period from a timing at which the upstream detector detects that the exhaust gas air-fuel ratio is converged on the stoichiometric ratio to a timing at which the downstream detector detects that the exhaust gas air-fuel ratio is the rich air-fuel ratio.

According to the above, since the correlation value is modified based on the integrated value of the amount of intake air over the time period from the point in time at which the upstream detector detects that the exhaust gas air-fuel ratio has converged on the stoichiometric ratio to the point in time at which the downstream detector detects that the exhaust gas air-fuel ratio is rich, setting of a correlation value using the integrated value of the air amount is enabled.

The correlation value may be a target value for an oxygen amount purged from the catalytic converter. The adjuster may be operable to adjust the target value based on the integrated value of the air amount.

According to the above, the rich change control can accurately be implemented by modifying the target oxygen purge amount.

The correlation value provider may be operable to increase the target value at a prescribed ratio, in a case that the integrated value of the air amount is no less than a prescribed value.

According to the above, the rich change control can accurately be implemented by increasing the target oxygen purge amount in association with an increase in the integrated value of the air amount.

The correlation value provider may be operable to decrease the target value at a prescribed ratio, in a case that the integrated value of the air amount is less than a prescribed value.

According to the above, the rich change control can accurately be implemented by decreasing the target oxygen purge amount in association with the decrease in integrated value of the air amount.

In addition, a more accurate modification can be enabled so that the amount of exhaust gases which have passed through the catalytic converter from the point in time at which the exhaust gas air-fuel ratio converges on the stoichiometric air-fuel ratio to the point in time at which the exhaust gas air-fuel ratio detected by the downstream detector is changed to the rich air-fuel ratio (the integrated intake air amount) becomes substantially the same as the capacity of the catalytic converter.

In a case that the downstream detector detects that the exhaust gas air-fuel ratio is the rich air-fuel ratio while the change executor executes the changing, the controller may be operable to cause the change executor to stop the changing, and is operable to adjust the target value based on the oxygen amount when the changing is stopped.

According to the above, when the downstream detector detects that the exhaust gas air-fuel ratio is rich in the midst of execution of the rich change by the change executor, the rich change operation is ended to modify the target oxygen purge amount, whereby the rich change control can be implemented accurately according to the actual exhaust gas condition.

The system may includes a condition detector, operable to detect a driving domain of the engine. In a case that the condition detector detects that the engine is driven at a low exhaust gas flow rate running domain in which the exhaust gas flow rate is less than a predetermined value, the correlation value provider may be operable to decrease the target value.

In a running region where the speed and load are low and the flow rate of exhaust gases is small, more reducing constituents tend to be consumed on the upstream side of the catalytic converter during the rich change control, and hence, the amount of reducing constituents is reduced which flows down to the downstream side of the catalytic converter. Due to this, there is caused a fear that the adsorbing condition of oxygen during the rich change control becomes uneven. To cope with this, in the running region of low speed, low load and low exhaust gas flow rate, the target purge amount of oxygen constituents is reduced so as to control the correlation value of the rich change control in such a way that no excessive rich changing occurs, and the modification of the correlation value according to the integrated value of the amount of intake air is preferably prohibited.

According to the above, when the internal combustion engine is determined to be running in the low exhaust gas flow rate running region, by reducing the target oxygen purge amount compared with the internal combustion engine running in the high exhaust gas flow rate running region, the imbalance in absorption of oxygen into the catalytic converter can be suppressed.

The adjuster may be operable to disable at least one of the target value and the correlation value from being adjusted.

According to the above, by prohibiting the modification of the correlated value in the running region where the flow rate of exhaust gases is low, the occurrence of a case can be avoided in which the modification of the correlation value becomes inaccurate, thereby making it possible to suppress the deterioration of the controlling performance of the catalytic converter.

The correlation value may be a timing at which the change executor stops the changing.

According to the above, the amount of exhaust gas emissions can be suppressed in a more ensured fashion by setting properly the ending timing of rich change control, thereby making it possible to implement the rich change control more accurately.

The change executor may be operable to execute the changing in a case that the fuel supply is once stopped for a time period longer than a prescribed value, and is then resumed.

When the fuel cut is performed for the prescribed time period or longer, it can be understood that oxygen is adsorbed evenly (substantially 100%) on the whole of the catalytic converter, and as this occurs, the rich change control can be implemented.

Note that for the oxygen purge amount, for example, a value can be used which is obtained by multiplying the exhaust gas air-fuel ratio detected by the upstream detector by the amount of intake air. In addition, for the upstream detector and the downstream detector, which are adapted to detect that the exhaust gas air-fuel ratio converges on the stoichiometric air-fuel ratio, an oxygen sensor for detecting an air-fuel ratio by outputting a signal when the oxygen concentration is high or an air-fuel ratio sensor (LAFS) for outputting a prescribed voltage value according to an air-fuel ratio can be adopted. When an oxygen sensor is used for the upstream detector, the stoichiometric condition can be determined based on a correction coefficient (an injection amount correction coefficient) according the fuel injection amount. In addition, it is also possible to use a means for estimating an exhaust gas air-fuel ratio by operation based on the injection volume correction coefficient or mapped data.

BRIEF DESCRIPTION OF THE DRAWINGS

Embodiment may be described in detail with reference to the accompanying drawings, in which:

FIG. 2 is a flowchart illustrating a control of a fuel supply resumption from a fuel cut condition;

FIGS. 4A to 4H are timing charts of the control of the fuel supply resumption from the fuel cut condition; and FIGS. 5A to 5H are timing charts of the control of the fuel supply resumption from the fuel cut condition.

DETAILED DESCRIPTION OF THE INVENTION

Hereinafter, an embodiment of the invention will be described based on the drawings. An internal combustion engine that will be illustrated in the embodiment below is a port injection, multi-cylinder (for example, four cylinders) gasoline engine. In addition, as internal combustion engines to which the invention can be applied, not only such port injection multi-cylinder gasoline engines but also direct injection gasoline engines and diesel engines can be used.

Figure 1:
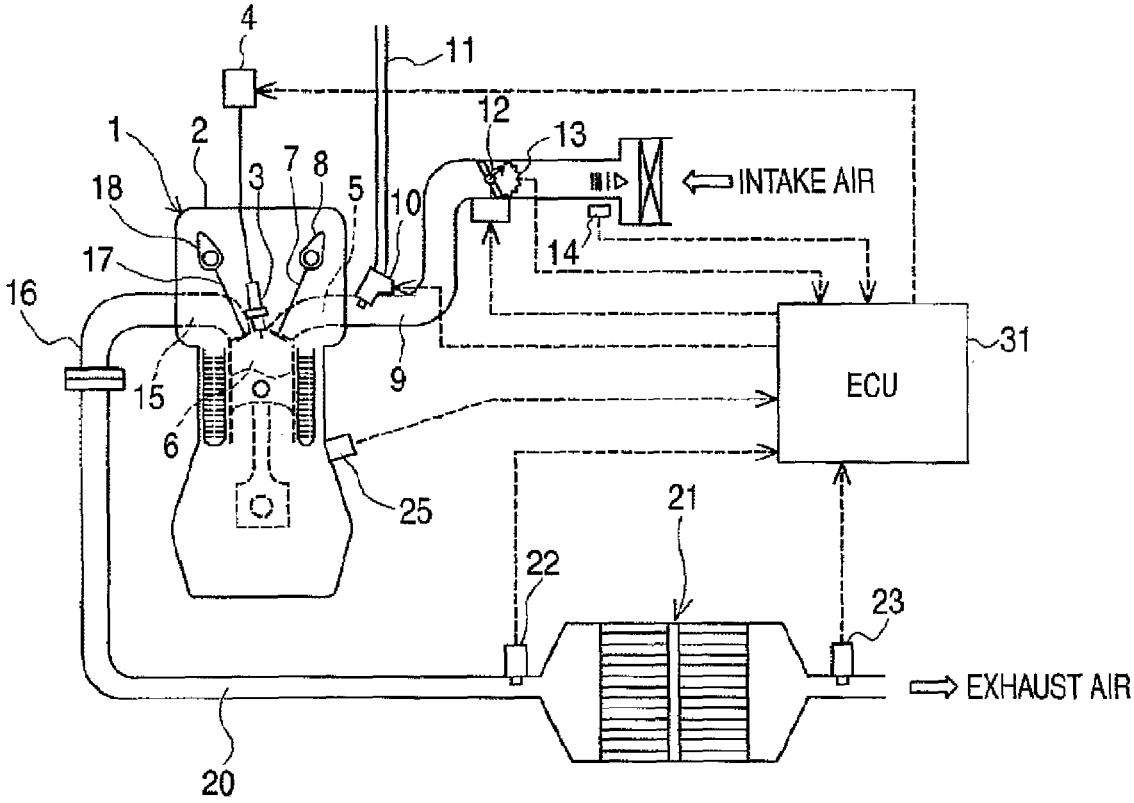
FIG. 1 is a schematic diagram showing the configuration of an exhaust gas emission control system for an internal combustion engine according to an embodiment of the intention.
Figure 3:
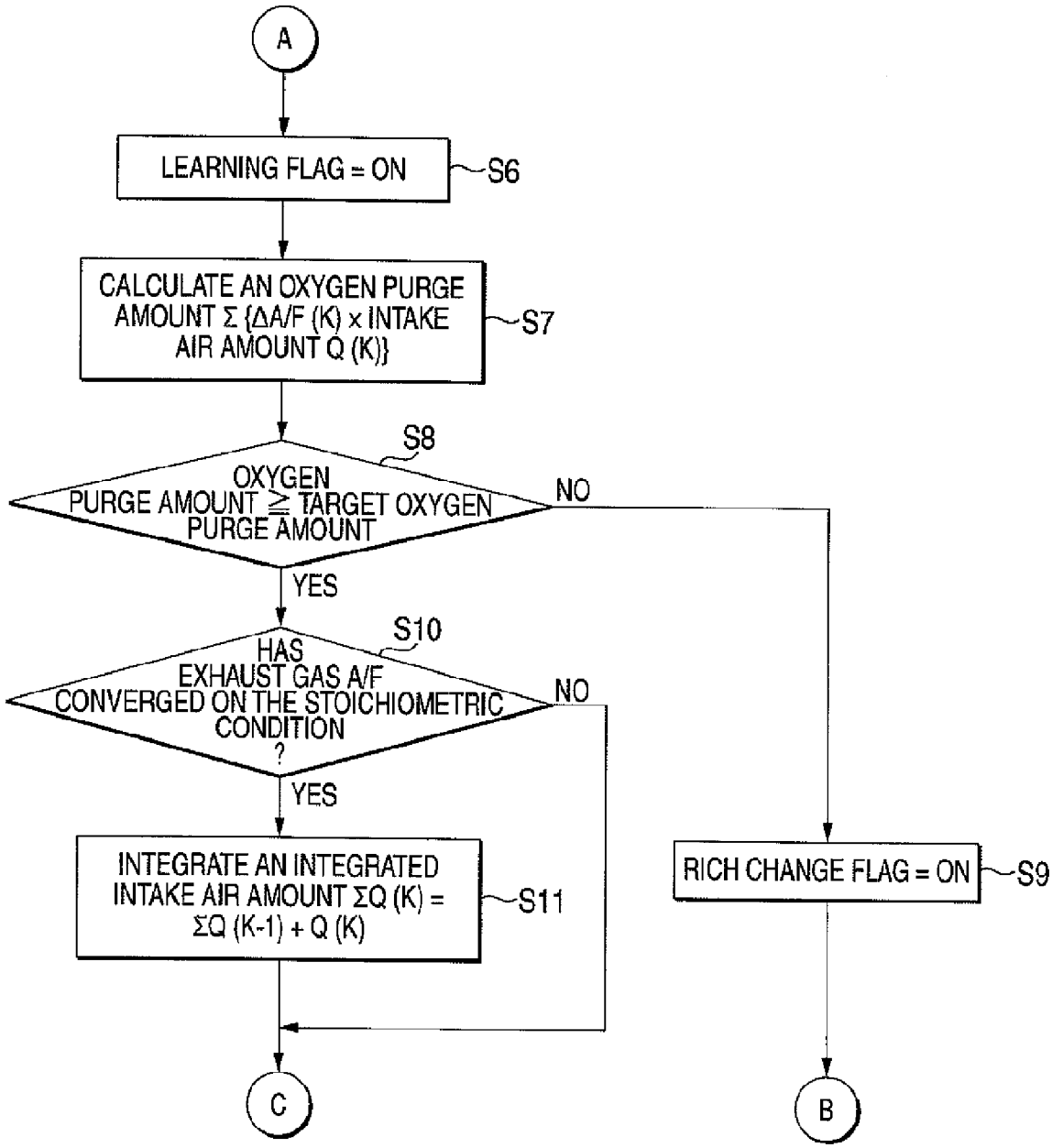
FIG. 3 is a flow chart illustrating the control of the fuel supply resumption from the fuel cut condition.

FIG. 1 is a schematic diagram showing the configuration of an exhaust gas emission control system for an internal combustion engine according to an embodiment of the invention, FIGS. 2 and 3 are flowcharts which illustrate a fuel supply resumption control after a fuel cut has been implemented, and FIGS. 4A to 4H and 5A to 5H are timing charts when the fuel supply resumption control is implemented.

Firstly, the configuration of the exhaust gas emission control system for an internal combustion engine will be described based on FIG. 1.

As is shown in FIG. 1, a spark plug 3 is mounted on a cylinder head 2 of an engine main body (hereinafter, referred to as an engine) 1 of an internal combustion engine for each cylinder. An ignition coil 4 for outputting a high voltage is connected to the spark plug 3. An intake port 5 is formed in the cylinder head 2 for each cylinder. An intake valve 7 is provided on a combustion chamber 6 side of each intake port 5. The intake valve 7 is actuated by a cam on a cam shaft 8 which rotates in response to the rotation of the engine, to thereby be operated to be opened and closed, so as to make and interrupt a communication between each intake port 5 and the corresponding combustion chamber 6.

An intake manifold 9 is connected to each intake port 5 at one end thereof to thereby establish a communication therebetween. A solenoid type fuel injection valve 10 is mounted on the intake manifold 9 in such a manner as to correspond to each cylinder. Each fuel injection valve 10 is connected to a fuel pipe 11. This fuel pipe 11 is connected to a fuel supply system, not shown, whereby fuel is supplied from a fuel tank, not shown, to the fuel injection valve 10 via the fuel pipe 11.

A solenoid type throttle valve 12 and a throttle position sensor (TPS) 13 for detecting the valve opening or position of the throttle valve 12 are provided in an intake pipe upstream of the intake manifold 9. Furthermore, an airflow sensor 14 (an air detector) for metering an intake air amount Q is provided upstream of the throttle vale 12. As the airflow sensor 14, for example, a Karman vortices air flow sensor or a hot film air flow sensor can be used.

On the other hand, an exhaust port 15 is formed in the cylinder head 2 for each cylinder. An exhaust valve 17 is provided on a combustion chamber 6 side of each exhaust port 15. The exhaust valve 17 is actuated by a cam on a cam shaft 18 which rotates in response to the rotation of the engine, to thereby be operated to be opened and closed, so as to make and interrupt a communication between each intake port 15 and the corresponding combustion chamber 6. In addition, an exhaust manifold 16 is connected to each exhaust port 15 at one end thereof to thereby be operated to be opened and closed, so as to make and interrupt a communication between each exhaust port 15 and the corresponding combustion chamber 6. In addition, since the port injection multi-cylinder gasoline engine is already known to the general public, a detailed description of the configuration thereof will be omitted here.

An exhaust pipe (exhaust passage) 20 is connected to the other end of the exhaust manifold 16. A three-way catalytic converter 21 is provided in the exhaust pipe 20 as a catalytic converter. The three-way catalytic converter 21 is such that at least any of copper (Cu), cobalt (Co), silver (Ag), platinum (Pt), rhodium (Rh), and palladium (Pd) is carried on a substrate. Alternatively, the three-way catalytic converter has as an auxiliary catalyst at least either of cerium (Ce) and zirconium (Zr), which has an oxygen absorbing function (oxygen storage function).

This auxiliary catalysts has a characteristic that when capturing (storage: adsorption, absorption) oxygen ($O_2$) in a high oxygen concentration atmosphere (oxidation atmosphere) in which an exhaust gas air-fuel ratio (exhaust gas A/F) is a lean air-fuel ratio (lean A/F), the auxiliary catalyst holds the captured oxygen (stored oxygen) in a zero dissociation state until the exhaust A/F becomes a rich air-fuel ratio (rich A/F) whereby a low oxygen concentration atmosphere (reduction atmosphere) is realized and to dissociate the captured oxygen for desorption in the reducing atmosphere, as well as a function to temporarily capture oxidations such as NOx and Sox.

A front oxygen sensor 22 is provided on the exhaust pipe 20 upstream (on an entrance side) of the three-way catalytic converter 21 as an upstream exhaust gas air-fuel ratio detection unit. This front oxygen sensor 22 is such as to detect an oxygen concentration in exhaust gases for use in a feedback control at the time of constant speed running. In addition, in place of this front oxygen sensor 22, a linear air-fuel ratio sensor (LAFS) can be used.

In addition, a rear oxygen sensor 23 is provided downstream (on an exist side) of the three-way catalytic converter 21 as a downstream exhaust gas air-fuel ratio detection unit. The rear oxygen sensor 23 is such as to detect an oxygen concentration in exhaust gases that have passed through the three-way catalytic converter 21.

An ECU (electronic control unit) 31 includes input/output modules, storage modules (ROM, RAM and the like), a central processing unit (CPU), a timer counter and the like. A general control of an air-fuel ratio control system including the engine 1 is implemented by this ECU 31.

In addition to the aforesaid TPS 13, airflow sensor 14, front oxygen sensor 22 and rear oxygen sensor 23, various types of sensors including a crank angle sensor 25 for detecting a crank angle of the engine 1 and a coolant temperature sensor, not shown, for detecting a coolant temperature in the engine 1 are connected to an input side of the ECU 31, and information from these sensors is inputted into the ECU 31. The engine speed or the like is determined based on information from the crank angle sensor 25 and the coolant temperature sensor, not shown, so as to determine the running region of the engine 1, whereby whether the engine 1 is in a low exhaust gas amount operation of low speed, low load and low flow rate of exhaust gases or a high exhaust gas amount operation of high speed, high load and high flow rate of exhaust gases is determined (a condition detector).

On the other hand, connected to an output side of the ECU 31 are various types of output devices such as those described above which includes the fuel injection valves 10, the ignition coils 4, and the throttle valve 12. A fuel injection amount, a fuel injection time, an ignition timing and the like which are calculated in the ECU 31 based on detection information sent from the various types of sensors are outputted to the associated various types of output devices. Specifically speaking, the air-fuel ratio is set to a proper target air-fuel ratio (target A/F) based on the detection information from the various types of sensors and normally is feedback controlled based on information from the front oxygen sensor 22. Namely, an amount of fuel associated with the target A/F is injected from the fuel injection valve 10 at a proper timing, the throttle valve 12 is adjusted to a proper opening, and a spark ignition is implemented at a proper timing by the spark plug 13.

In the engine 1 of the embodiment, the fuel supply is configured to be temporarily stopped while the vehicle is running so as to implement a fuel cut (a cutter). Namely, in the engine 1, when the driver stops depressing an accelerator pedal, not shown, and the engine speed Ne is a prescribed speed or higher, the fuel cut is made to be implemented as required by stopping the fuel injection from the fuel injection valves 10. In addition, in the engine 1, the target A/F is designed to be set to the rich A/F immediately the fuel supply is resumed once the fuel cut has been implemented, or immediately the fuel supply is resumed from the fuel-cut condition. By setting the target A/F to the rich A/F, a sufficient engine output can be obtained immediately after the fuel supply is resumed from the fuel-cut condition, and a large amount of oxygen stored in the three-way catalyst 21 due to the fuel cut is released.

In addition, the fuel cut may be implemented over all the cylinders or on part of the cylinders.

In the exhaust gas emission control system that has been described above, the fuel supply resumption from the fuel-cut condition is implemented after the fuel cut has been implemented over a prescribed time period or longer (a prescribed stop of fuel supply), and a rich change control is executed after the fuel supply has been resumed from the fuel-cut condition (a change executor). The fuel cut over the prescribed time period or longer is a time period over which oxygen is (or is considered to be) evenly stored in the whole of the three-way catalytic converter 21. Note that in the event that oxygen is not evenly stored in the whole of the three-way catalytic converter 21, that is, in the event that the fuel cut has not yet been implemented over the prescribed time period or longer, the rich change control is not executed.

In addition, in place of the prescribed time period, the amount of oxygen that passes through the catalytic converter during a time period over which the fuel cut is implemented may be calculated, so as to determine whether or not oxygen is stored evenly in the catalytic converter. The amount of oxygen that passes through the catalytic converter can be obtained from a product of an integrated intake air amount during the time period over which the fuel cut is implemented and oxygen concentration (about 21%) in air.

A target oxygen purge amount, which is a target value of an oxygen purge amount which constitutes a target when the fuel supply is resumed from the fuel-cut condition, is set as a correlation value which is correlated with richness or rich change extent (a correlation value provider). In addition, the target oxygen purge amount is modified (increased or decreased) based on an integrated value of the amount of intake air (integrated intake air amount) $\Sigma Q$ from a point in time at which the exhaust gas A/F is detected to have converged on the stoichiometric condition (the exhaust gas A/F has converged on the stoichiometric air-fuel ratio) to a point in time at which the rear oxygen sensor 23 outputs a rich voltage (rich determination). Namely, the integrated intake air amount $\Sigma Q$ from the exhaust gas A/F has converged on the stoichiometric condition to the rich A/F determination is made is taken as a parameter which reflects the capability of the catalytic converter.

Namely, the time period spent until the exhaust gases that have flowed through the three-way catalytic converter 21 after the exhaust gas A/F converged on the stoichiometric condition reach the rear oxygen sensor 23 is corrected based on the integrated intake air amount $\Sigma Q$ (the parameter which reflects the capability of the catalytic converter), and the target oxygen purge amount is modified based on the integrated intake air amount $\Sigma Q$ (an adjuster), whereby an ending timing at which the oxygen purge amount becomes the target oxygen purge amount is modified. The change executor is then controlled according to the modification so implemented for the next rich change control (a controller).

In this case, in order to synchronize the ending timing of the rich change, the target oxygen purge amount, which is the correlation value, is modified. In other words, the ending timing of the rich change in which the oxygen purge amount becomes target oxygen purge amount is taken as the correlation value which is correlated with the rich change extent.

Due to this, a rich change period (rich change ending timing) is set based on an actual running condition according to the oxygen purge amount, and the stoichiometric condition can be detected at the exit of the three-way catalytic converter 21 at the same time as exhaust gases on which the rich change control has been completed and which have been feedback controlled to the vicinity of the stoichiometric condition 6 arrives at the exist side of the three-way catalytic converter. Namely, it is controlled such that the rich change control ends in the prescribed time period which is set to a time period over which the intake air amount equals the capacity of the three-way catalytic converter 21 since the exhaust gas A/F converged on the stoichiometric condition (the current capacity of the three-way catalytic converter 21 and the integrated intake air amount become substantially equal to each other).

Additionally, since the accurate rich change control can be implemented irrespective of the capability (deterioration) of the catalytic converter 21, the exhaust gas emission controlling performance can be increased by suppressing exhaust gas emissions.

In addition, as the correlation value which is correlated with the rich change extent, in addition to the target oxygen purge amount, rich A/F depth, which is the rich change extent by itself, and a rich change ending timing, which is set in correlation with the rich change extent separately from the ending timing at which the oxygen purge amount becomes the target oxygen purge amount, can be used. In addition, as the parameter which reflects the capability (deterioration) of the catalytic converter, a period (time) can be used from the exhaust gas A/F converges on the stoichiometric air-fuel ratio to the rich A/F determination is made.

Here, the oxygen purge amount is calculated from the exhaust gas A/F and the intake air amount which is detected by the airflow sensor 14. In addition, the integrated intake air amount ΣQ resulting while the rich change is executed may be used in place of the oxygen purge amount. In addition, as to the stoichiometric convergence of the exhaust gas A/F, whether or not the exhaust gas A/F has converged on the stoichiometric condition or air-fuel ratio can be determined by multiplying a detection value of the front oxygen sensor 22 by a correction coefficient according to the fuel injection amount. In the case of a linear air-fuel ratio sensor (LASS) which outputs a voltage value according to the air-fuel ratio being used in place of the front oxygen sensor, the stoichiometric convergence of the exhaust gas A/F can be determined by an output value from the sensor in question.

A rich change control situation occurring in the exhaust gas emission control system when the fuel supply is resumed from the fuel cut condition will be described in detail based on FIGS. 2, 3 and 4A to 4H.

FIGS. 4A to 4H show cases where the stoichiometric convergence of the exhaust gas A/F is determined and the target oxygen purge amount is learning corrected using the rear oxygen sensor 23, and FIGS. 5A to 5H show cases where the rear oxygen sensor 23 detects the rich change before the stoichiometric convergence is determined during the rich change. In FIGS. 4A and 5A show on/off (execution/non-execution) situations of the rich change control when the fuel supply is resumed from the fuel cut condition, FIGS. 4B and 5B show on/off (learning control execution/non-execution) situations of the target oxygen purge amount learning, FIGS. 4C and 5C show situations of a fuel injection amount correction coefficient, FIGS. 4D and 5D show exhaust gas A/F situations, FIGS. 4E and 5E show oxygen purge amount situations, FIGS. 4F and 5F show oxygen storage amount situations, FIGS. 4G and 5G show output situations of the front oxygen sensor 22 and the rear oxygen sensor 23, and FIGS. 4H and 5H show integrated intake air mount ΣQ situations.

As is shown in FIG. 2, when the operation starts, at step S1, whether or not a fuel cut is being performed is determined, and if it is determined that the fuel cut is being performed (Yes), at step 2, a learning flag is set to OFF, the oxygen purge amount is set to 0, and the integrated intake air amount is set to 0. Then, at step 3, a rich change flag is set to OFF (the rich change control when the fuel supply is resumed from the fuel cut condition is OFF), and the operation returns.

If it is determined at step S1 that the fuel cut is not performed (No), at step S4, whether or not a rich change condition when the fuel supply is resumed from the fuel cut condition has been established is determined. The rich change condition when the fuel supply is resumed from the fuel cut condition is taken as, for example, a condition in which a fuel cut is executed over a prescribed time period so that oxygen is (or is regarded to be) evenly stored in the three-way catalytic converter 21.

If it is determined at step S4 that the rich change condition when the fuel supply is resumed from the fuel cut condition is established (Yes), at step S5, whether or not an output of the rear oxygen sensor 23 is rich (whether or not a voltage is detected) is determined. Normally, since the output of the rear oxygen sensor 23 is not rich immediately after the fuel cut is performed, the output is determined not to be rich (No) at step S5, the operation proceeds to step S6 shown in FIG. 3 (A).

As is shown in FIG. 3, the learning flag is set to ON at step S6, and at step S7, a calculation of an oxygen purge amount is started. An oxygen purge amount is calculated by integrating a change in product of the exhaust gas A/F and the intake air amount Q. Namely, the oxygen purge amount is calculated by $\Sigma\{\Delta \text{ exhaust gas A/F}(k)\times\text{intake air amount } Q(k)\}$. $\Sigma\{\Delta \text{ exhaust gas A/F}(k)\times\text{intake air amount } Q(k)\}$ is a total of products of a variation of the exhaust gas A/F and the intake air amount Q and corresponds to the area of a rich air-fuel ratio region, as is indicated by shaded portions in FIGS. 4D and 5D.

Incidentally, by performing a filtering operation on a correction coefficient according to a fuel injection amount (an injection amount correction coefficient), the exhaust gas A/F can be estimated as is indicated by solid lines in FIGS. 4D and 5D. In the event that the exhaust gas A/F is estimated without performing any filtering operation on the injection amount correction coefficient, as is indicated by dotted lines in FIGS. 4D and 5D, a state results in which the value of the exhaust gas A/F rises drastically at the ending timing of the rich change.

Returning to the operation, after the oxygen purge amount is calculated at step S7, at step S8, whether or not the oxygen purge amount is equal to or more than the target oxygen purge is determined, and normally, since the oxygen purge amount is determined to be lower than the target oxygen purge amount (No) immediately after the control has been started, at step 9, the rich change flag is set to ON, and the operation returns (B).

Namely, the rich change control when the fuel supply is resumed from the fuel cut condition becomes ON, as is shown in FIGS. 4A and 5A, and the target oxygen purge amount learning control becomes ON, as is shown in FIGS. 4B and 5B. In addition, the fuel injection amount correction coefficient is set to a desired fuel injecting situation (a rich change extent situation for a rich change controlling fuel supply). In addition, the exhaust gas A/F starts to be changed to the rich A/F as is shown in FIGS. 4D and 5D, the oxygen purge amount starts to increase as is shown in FIGS. 4E and 5E, the oxygen storage amount in the three-way catalytic converter 21 starts to decrease as is shown in FIGS. 4F and 5F, and an output voltage is generated in the front oxygen sensor 22 as is shown in FIGS. 4G and 5G.

If it is determined at step S8 that the oxygen purge amount is equal to or more than the target oxygen purge amount (Yes), that is, if it is determined that the oxygen purge amount shown in FIG. 4E has reached the target oxygen purge amount, it is taken as the rich change ending timing, and the air-fuel ratio is changed back to the stoichiometric side by lowering the injection amount as is shown in FIG. 4C. Then, the operation proceeds to step S10, where whether or not the exhaust gas A/F has converged on the stoichiometric condition or air-fuel ratio is determined.

The determination of whether or not the exhaust gas A/F has converged on the stoichiometric condition is made by calculating the injection amount correction coefficient shown in FIGS. 4C and 5C through filtering operation to thereby obtain the exhaust gas A/F. In addition, in the event that the linear air-fuel ratio sensor (LAFS) is used in place of the front oxygen sensor 22, the stoichiometric convergence of the exhaust gas A/F can be determined from the output of the sensor in question.

If it is determined at step S10 that the exhaust gas A/F has not converged on the stoichiometric condition (No), since the exhaust gas A/F has not converged on the stoichiometric condition although the oxygen purge amount has reached the target oxygen purge amount and hence it is then the rich change ending timing, the operation proceeds to steps S3 in FIG. 2, where the rich change flag is set to OFF, and then returns (C).

If it is determined at step S10 that the exhaust gas A/F has converged on the stoichiometric condition (Yes), an integrated intake air amount $\Sigma Q(k)$ is integrated at step S1. Namely, $\Sigma Q(k)=\Sigma Q(k-1)+Q(k)$ is used for calculation. In other words, the integration of intake air amount is started and the calculation of the integrated intake air amount $\Sigma Q(k)$ is started from a point in time at which the rich change ending timing is reached by the oxygen purge amount reaching the target oxygen purge amount and the stoichiometric convergence of the exhaust gas A/F is detected, and as is shown in FIG. 4H, the integrated intake air amount $\Sigma Q$ starts to increase from a point in time at which the exhaust gas A/F has converged on the stoichiometric condition.

Although a detailed description will be made later, in this state, the target oxygen purge amount is modified depending upon the quantity of the integrated intake air amount $\Sigma Q$ until the output of the rear oxygen sensor 23 rises (depending upon the capability of the three-way catalytic converter 21), and then the rich change ending timing (a timing at which the oxygen purge amount reaches the target oxygen purge amount) is corrected. Consequently, the target oxygen purge amount is modified (increased or decreased) based on the integrated intake air amount $\Sigma Q$ over a time period from the detection of the stoichiometric convergence of the exhaust gas A/F until the detection of the rich A/F voltage by the rear oxygen sensor 23, and then, the prescribed time period of the rich change is made to be changed. Namely, the prescribed time period which constitutes the target of the rich change control is set using the oxygen purging situation based on the index of the actual exhaust gas A/F.

On the other hand, returning to FIG. 2, if the output of the rear oxygen sensor 23 is determined to be rich at step S5 (Yes), namely, a state in which the output of the rear oxygen sensor 23 has risen is determined after the calculation of the integrated intake air amount $\Sigma Q$ has been started, whether or not the exhaust gas A/F has converged on the stoichiometric condition is confirmed at step S12. Since the exhaust gas A/F is determined to have converged on the stoichiometric condition if the determination is made after the calculation of the integrated intake air amount $\Sigma Q$ has been started, the operation proceeds to step S13, where whether or not the learning flag is ON is determined.

Since if the operation shown in FIG. 3 has been executed, it is determined that the learning flag is ON at step S13 (Yes), then, proceed to step S14, where whether or not the engine speed and load are equal to or more than prescribed values. On the other hand, if it is determined at step S13 that the learning flag is not ON (No), then, proceed to step S3, where the rich change flag is set to OFF and the operation returns.

If it is determined at step S14 that the engine speed and load are less than the prescribed values (No), it is determined that the engine is running at low speed and with low load (the low exhaust gas flow rate running region), and the operation proceeds to step S2. Namely, the rich change control is ended at the point in time at which the engine is determined to be running in the low exhaust gas flow rate running region.

Since the ratio of consumption of reducing constituents on the upstream side of the three-way catalytic converter 21 during the rich change control becomes high and hence the amount of reducing constituents flowing down to the downstream side of the three-way catalytic converter 21 is reduced, there is a fear that the storage condition of oxygen during rich change control becomes uneven.

Then, in such a state that the low exhaust gas flow rate running region is determined (a condition detector) and the engine is running in the low exhaust gas flow rate running region where the flow rate of exhaust gases is low, the target oxygen purge amount is made smaller (set smaller) than when the engine is running in the high exhaust gas flow rate running region where the flow rate of exhaust gases is high. The prescribed time period for the rich change control is shortened by reducing the target oxygen purge amount, and the modification of the target oxygen purge amount according to the integrated intake air amount $\Sigma Q$ is prohibited (open loop control).

By this, the rich change control is limited to a short time period in the low exhaust gas flow rate running region, whereby unevenness in storage condition of oxygen in the three-way catalytic converter 21 can be suppressed. In addition, by prohibiting the modification of the target oxygen purge amount in the low exhaust gas flow rate running region, inaccuracy in modification of the target oxygen purge amount can be avoided, thereby making it possible to suppress the deterioration in the exhaust gas emission controlling capability of the catalytic converter after transition to a stoichiometric feedback control.

Returning to the operation, if it is determined at step S14 that the engine speed and load are equal to or more than the prescribed values (Yes), it is determined at step S15 whether or not the integrated intake air amount $\Sigma Q(k)$ is equal to or more than a prescribed target value.

If it is determined at step S15 that the integrated intake air amount $\Sigma Q(k)$ is equal to or more than the prescribed target value (Yes), at step S16, the target oxygen purge amount is increased by a prescribed ratio so as to delay the rich change ending timing, and the operation proceeds to step S2. Namely, the target oxygen purge amount shown in FIG. 4H is increased to an upper side, so as to delay the rich change ending timing.

If the integrated intake air amount $\Sigma Q(k)$ is equal to or more than the prescribed target value, the rise of the rear oxygen sensor 23 is delayed from an estimated rise, and therefore, this is taken as a state in which much time has to be spent from the rich change is performed and the exhaust gas A/F has converged on the stoichiometric condition to the rear oxygen sensor 23 on the exit side of the three-way catalytic converter 21 rises, and there still exists a state in which even though the exhaust gas A/F has converted on the stoichiometric condition, the reducing agent is being used for purging oxygen stored in the catalytic converter, hence, a lean condition resulting.

Due to this, the three-way catalytic converter 21 is determined to have much oxygen stored therein, and the target oxygen purge amount is increased by a prescribed ratio so as to extend the rich change time period, so that the purging of stored oxygen can be implemented sufficiently. By extending the rich change time period so as to delay the rich change ending timing, even though the three-way catalytic converter 21 is having much oxygen stored therein, the oxygen so stored can be purged in an ensured fashion.

On the other hand, if it is determined at step S15 that the integrated intake air amount ΣQ(k) is less than the prescribed target value (No), the target oxygen purge amount is reduced by a prescribed ratio so as to put forward the rich change ending timing at step S17, and the operation proceeds 6 to step S2. Namely, the target oxygen purge amount shown in FIG. 4E is increased to a lower side, so as to put forward the rich change ending timing.

If the integrated intake air amount ΣQ(k) is less than the prescribed target value, the rise of the rear oxygen sensor 23 is earlier than the estimated rise, and therefore, this is taken as a state in which less time is spent from the rich change is performed and the exhaust gas A/F has converged on the stoichiometric condition to the rear oxygen sensor 23 on the exit side of the three-way catalytic converter 21 rises, and there exists a state in which stored oxygen has been purged within a short time period after the exhaust gas A/F has converted on the stoichiometric condition. Due to this, the three-way catalytic converter 21 is determined to have less oxygen stored therein, and the target oxygen purge amount is reduced by a prescribed ratio so as to shorten the rich change time period, so that the purging of stored oxygen can be implemented within a required least time period.

By shortening the rich change time period so as to put forward the rich change ending timing, in the event that three way catalytic converter 21 is having less oxygen stored therein, stored oxygen can be purged within a least optimum time period, whereby the unused reducing agent is discharged, and hence, there is no fear that the exhaust gas emission controlling capability of the three-way catalytic converter is deteriorated.

Namely, the amount of exhaust gases that have passed through the three-way catalytic converter 21 from the exhaust gas A/F has converted on the stoichiometric condition to the rear oxygen sensor 23 has been changed to the prescribed rich A/F (converted into the integrated intake air amount ΣQ(k)) is corrected to be substantially identical to the capacity of the three-way catalytic converter 21 irrespective of how much the three-way catalytic converter 21 stores oxygen therein, whereby the amount of exhaust gas emissions of the three-way catalytic converter 21 is suppressed, thereby making it possible to increase the exhaust gas controlling performance thereof.

Note that although the rich change ending timing is put forward or backward by decreasing or increasing the target oxygen purge amount, it is also possible to put forward or delay the rich change timing by correcting the rich A/F depth by increasing or decreasing the target oxygen purge amount and changing the rate of change of the oxygen purge amount which is increased or decreased. In addition, a rich change ending timing is set separately from the control based on the target oxygen purge amount, and this rich change ending timing may be taken as a correlation value which is correlated with the rich change extent. For example, although this will be described later, by taking a rise of the output of the rear oxygen sensor 23 before the stoichiometric convergence of the exhaust gas A/F as a rich change ending timing, this rich change ending timing may be made to be taken as the correlation value which is correlated with the rich change extent.

Returning to the operation, if it is determined at step S12 that the exhaust gas A/F has not yet converged on the stoichiometric condition (No), it is determined that a state is resulting in which the output of the rear oxygen sensor 23 has risen before the exhaust gas A/F has converged on the stoichiometric condition (while the rich change is being carried out), and then, the operation proceeds to step S18, where the target oxygen amount is modified to a value which is obtained by multiplying the current oxygen purge amount by a prescribed value, the operation then proceeding to stop S2.

Namely, as is shown in FIG. 5G, in the event that the output of the rear oxygen sensor 23 has risen before the exhaust gas A/F converses on the stoichiometric condition, the rich change is ended (the rich change ending timing), the target oxygen purge amount is modified by taking a maximum oxygen storage amount at this point in time as the oxygen purge amount of the three-way catalyst converter 21. Specifically, a value obtained by multiplying the maximum oxygen storage amount, which is taken as the oxygen purge amount of the three-way catalytic converter 21, by a prescribed ratio (for example, 0.5 to 0.7) is taken as a new target oxygen purge amount. The prescribed ratio is such as to be set in advance based on the prior knowledge and is a ratio for reducing the target oxygen purge amount relative to the maximum oxygen storage amount.

Due to this, in the event that the output of the rear oxygen sensor 23 has risen before the exhaust gas A/F converges on the stoichiometric condition, this is taken as the end of the rich change prescribed time, and a new target oxygen purge amount is calculated based on the maximum oxygen storage amount at this point in time (based on the oxygen purge amount), so as to set a prescribed time period, and even in the event that the exhaust gas A/F is changed to the rich A/F at the exit side of the three-way catalytic converter 21 based on the running conditions, the rich change control can accurately be implemented (according to the actual exhaust gas condition).

Consequently, in the exhaust gas emission control system for an internal combustion engine that has been described heretofore, the prescribed time period over which the exhaust gas A/F is set to the rich A/F when the fuel supply is resumed from the fuel cut condition is set based on the target oxygen purge amount when the fuel supply is resumed from the fuel cut condition, and the target oxygen purge amount is increased or decreased based on the integrated intake air amount ΣQ over the time period from the exhaust gas A/F is determined to have converged on the stoichiometric condition to the rear oxygen sensor 23 outputs the rich A/F voltage. Because of this, the rich change time period can be set by a time period based on the actual running condition according to the oxygen purge amount, whereby the stoichiometric condition can be detected at the exit of the three-way catalytic converter 21 at the same time as the exhaust gases which have been feedback controlled to the vicinity of the stoichiometric condition resulting after the rich change control is ended arrive at the exit side of the three-way catalytic converter 21.

Namely, the rich change control is controlled so as to be ended in the prescribed time period which is set to the time period from the exhaust gas A/F has converged on the stoichiometric condition to the intake air amount equals the capacity of the three-way catalytic converter 21 (the current capacity of the three-way catalytic converter 21 becomes substantially the integrated intake air amount ΣQ).

By this configuration, irrespective of the running conditions or the deterioration of the three-way catalytic converter 21, the rich change control ending timing after the fuel cut is set properly and the release of oxygen is implemented accurately, thereby making it possible to increase the exhaust gas emission controlling performance of the three-way catalytic converter 21 by suppressing the amount of exhaust gas emissions of the three-way catalytic converter 21. In addition, in coping with the reduction in exhaust gas emission level, the increase in cost triggered by the catalyst can be suppressed to a least level. Furthermore, the amount of noble metals used in the catalyst can be reduced without reducing the exhaust gas emission controlling capacity.

In the embodiment that has been described heretofore, while the three-way catalytic converter 21 is described as a catalytic converter, the control that has been described can also be applied to other types of catalytic converters which use noble metals.

In addition, in the embodiment described above, while the target oxygen purge amount is increased or decreased according to the integrated intake air amount, it is also possible to execute either of the increase and decrease of the target oxygen purge amount depending upon the conditions of the three-way catalytic converter or the relationship with other controls.

Additionally, it is also possible to calculate a new target oxygen purge amount as the rich change ending timing when the output of the rear oxygen sensor 23 rises without determining the stoichiometric convergence of the exhaust A/F depending upon the conditions of the three-way catalytic converter 21 or the running conditions of the internal combustion engine. As this occurs, the rich change ending timing is used as the correlation value which is correlated with the rich change extent. In addition, the rich change control in which the rise of the output of the rear oxygen sensor 23 is taken as the rich change ending timing and the rich change control in which the timing at which the target oxygen purge amount is modified by the integrated intake air amount $\Sigma Q$ by determining the stoichiometric convergence of the exhaust gas A/F according to the running conditions of the internal combustion engine or the conditions of the three-way catalytic converter 21 whereby the oxygen purge amount constitutes the target oxygen purge amount is taken as the rich change ending timing are combined with each other for selective execution.

Furthermore, in the embodiment above, while the target oxygen purge amount is set (modified) by the integrated intake air amount $\Sigma Q$ based on the intake air amount, should the case allow this, the target oxygen purge amount can be set (modified) based on the integrated exhaust gas amount.

The invention is not limited to the embodiment that has been described heretofore, provided that when changing the air-fuel ratio to the rich air-fuel ratio after the fuel supply is resumed after the prescribed fuel cut has been carried out, the correlation value is set which is correlated with the rich change extent, this correlation value is modified based on the parameter which reflects the capability of the catalytic converter, the next rich change is executed based on the modified results, and the accurate rich change control can be implemented irrespective of the capability of the catalytic converter or the running conditions of the internal combustion engine.

The invention can be applied to the industrial field of exhaust gas emission control systems for internal combustion engines.

What is claimed is:

1. An exhaust gas purifying apparatus for an internal combustion engine, comprising:

a catalyst provided in an exhaust gas passage of the internal combustion engine;

an upstream side exhaust gas air-fuel ratio detector provided in an upstream side of the catalyst, a downstream side exhaust gas air-fuel ratio detector provided in a downstream side of the catalyst, a fuel cutter that temporally stops a fuel supply to the internal combustion engine;

a rich change executor that executes changing of an air-fuel ratio of the internal combustion engine to a rich air-fuel ratio after the fuel supply is once stopped by the fuel cutter and then resumed;

a setter that sets up a correlation value correlated to a degree of the changing to the rich air-fuel ratio by the rich change executor in accordance with a driving condition of the internal combustion engine;

a corrector that corrects the correlation value set by the setter, on the basis of a period from a time point that the upstream side exhaust gas air-fuel ratio detector detects that the exhaust gas air-fuel ratio converges on the stoichiometric ratio until a time point that the downstream side exhaust gas air-fuel ratio detector detects that the exhaust gas air-fuel ratio is the rich air-fuel ratio; and a controller that controls the rich change executor to execute the next changing in accordance with a correction result of the corrector.

2. The exhaust gas purifying apparatus for an internal combustion engine according to claim 1, wherein the correlation value is a timing at which the changing to the rich air-fuel ratio is ended.

3. The exhaust gas purifying apparatus for an internal combustion engine according to claim 1, wherein the predetermined stop of fuel supply is a stop of fuel supply over a prescribed period of time or longer.

4. The exhaust gas purifying apparatus for an internal combustion engine according to claim 1, further comprising:

an intake air amount detector that detects an air amount introduced into the internal combustion engine, wherein the corrector uses an integrated value of the air amount as the period.

5. The exhaust gas purifying apparatus for an internal combustion engine according to claim 4, wherein the correlation value is a target oxygen purge amount which is a target value for an oxygen amount purged from the catalyst during execution of the changing to the rich air-fuel ratio; and the corrector corrects the target oxygen purge amount based on the integrated value of the air amount.

6. The exhaust gas purifying apparatus for an internal combustion engine according to claim 5, wherein the setter increases the target oxygen purge amount at a prescribed ratio, when the integrated value of the air amount is not less than a prescribed value.

7. The exhaust gas purifying apparatus for an internal combustion engine according to claim 5, wherein the setter decreases the target oxygen purge amount at a prescribed ratio, when the integrated value of the air amount is less than a prescribed value.

8. The exhaust gas purifying apparatus for an internal combustion engine according to claim 5, wherein when the downstream exhaust gas air-fuel ratio detector detects that the exhaust gas air-fuel ratio is the rich air-fuel ratio while the rich change executor executes the changing, the controller causes the rich change executor to stop the changing at a point in time at which the exhaust gas air-fuel ratio is detected to be the rich air-fuel ratio, and corrects the target oxygen purge amount based on an amount of oxygen purged from the catalyst at that point in time.

9. The exhaust gas purifying apparatus for an internal combustion engine according to claim 5, further comprising a determiner that determines a driving domain of the internal combustion engine, wherein when the determiner determines that the engine is driven at a low exhaust gas flow rate running domain, the setter sets the target oxygen purge amount smaller than when in a high exhaust gas flow rate running domain.

10. The exhaust gas purifying apparatus for an internal combustion engine according to claim 9, wherein when the determiner determines that the engine is driven at a low exhaust gas flow rate running domain, the corrector prohibits the correction.

* * * * *